US007591684B2

(12) United States Patent
Zhang et al.

(10) Patent No.: US 7,591,684 B2
(45) Date of Patent: Sep. 22, 2009

(54) ELECTRICAL CONNECTOR

(75) Inventors: Ming Zhang, Kunshan (CN); Hong-Fang Wang, Kunshan (CN); Qiao-Li Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 159 days.

(21) Appl. No.: 11/974,343

(22) Filed: Oct. 12, 2007

(65) Prior Publication Data

US 2008/0176429 A1 Jul. 24, 2008

(30) Foreign Application Priority Data

Oct. 12, 2006 (CN) ..... 2006 1 0096618

(51) Int. Cl.
*H01R 24/00* (2006.01)

(52) U.S. Cl. ..... 439/660; 439/607.05; 439/108

(58) Field of Classification Search ..... 439/660, 439/607.05, 607.08, 108, 79
See application file for complete search history.

(56) References Cited

U.S. PATENT DOCUMENTS

| | | | | |
|---|---|---|---|---|
| 6,537,087 | B2 * | 3/2003 | McNamara et al. | 439/108 |
| 6,783,400 | B2 | 8/2004 | Wu et al. | |
| 7,070,424 | B2 | 7/2006 | Obikane et al. | |
| 7,294,019 | B1 * | 11/2007 | Jeon et al. | 439/608 |
| 2003/0232538 | A1 * | 12/2003 | Huang | 439/608 |
| 2005/0282437 | A1 * | 12/2005 | Fan | 439/608 |
| 2006/0094292 | A1 * | 5/2006 | Shindo | 439/541.5 |

* cited by examiner

*Primary Examiner*—Hien Vu
(74) *Attorney, Agent, or Firm*—Wei Te Chung

(57) ABSTRACT

An electrical connector comprises a longitudinal insulating housing defining a plurality of grooves and a plurality of contacts received in the groove. Each contact has a contacting arm, a retaining portion retained into the insulating housing and a soldering portion. The contacts comprises a plurality of signal contacts and grounding contacts, at least one signal contacts defining a signal group and at least one grounding contact defining a grounding group, each signal group and each grounding group are alternately arranged.

9 Claims, 5 Drawing Sheets

ELECTRICAL CONNECTOR

BACKGROUND OF THE INVENTION

1. Field of the Invention

The present invention relates to a board to board connector.

2. Description of Related Art

A board to board connector assembly is used to electrical link two print circuit boards. Some equipments, such as HD ("Hard Disk"), need a high working power, and a high quality signal transmission. A board-to-board connector used for connecting HD is capable of transmitting high current and high-frequency signals, steadily, furthermore, the connector must prevent cross-interference between signals. Present board-to-board connectors can not fully meet the above requirements, and do not have a perspective impedance to make sure the connector steadily transmits the high current and high-frequency signals.

U.S. Pat. No. 6,783,400 discloses such a board-to-board connector having an insulting housing and a plurality of contacts received in the insulating housing, the contacts include a plurality of signal contacts, a plurality of grounding contacts and a plurality of shielding contacts, wherein every two signal contacts has a grounding contact or a shielding contacts disposed therebetween to form a contact group, and each contact group has a distance with adjacent contact group. By this way, the connector can obtain a perfective impedance and reduce cross-interference between the signal contacts. But the connector having such contact array still can not fit the requirements for linking HD.

Hence, an improved connector is required to overcome the disadvantages of the prior art.

SUMMARY OF THE INVENTION

An object of the present invention is to provide a connector which can steadily transmitting current and signals.

Accordingly, to achieve above-mentioned object, an electrical connector comprises a longitudinal insulating housing defining a plurality of grooves and a plurality of contacts received in the grooves, each contact having a contacting arm, a retaining portion retained into the insulating housing and a soldering portion. The contacts comprises a plurality of signal contacts and grounding contacts, at least two signal contacts define a signal group and at least one grounding contact defines a grounding group, each signal group and each grounding group are alternately arranged, a distance between a signal group and a adjacent grounding group is larger than a distance of adjacent signal contacts in a same signal group.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
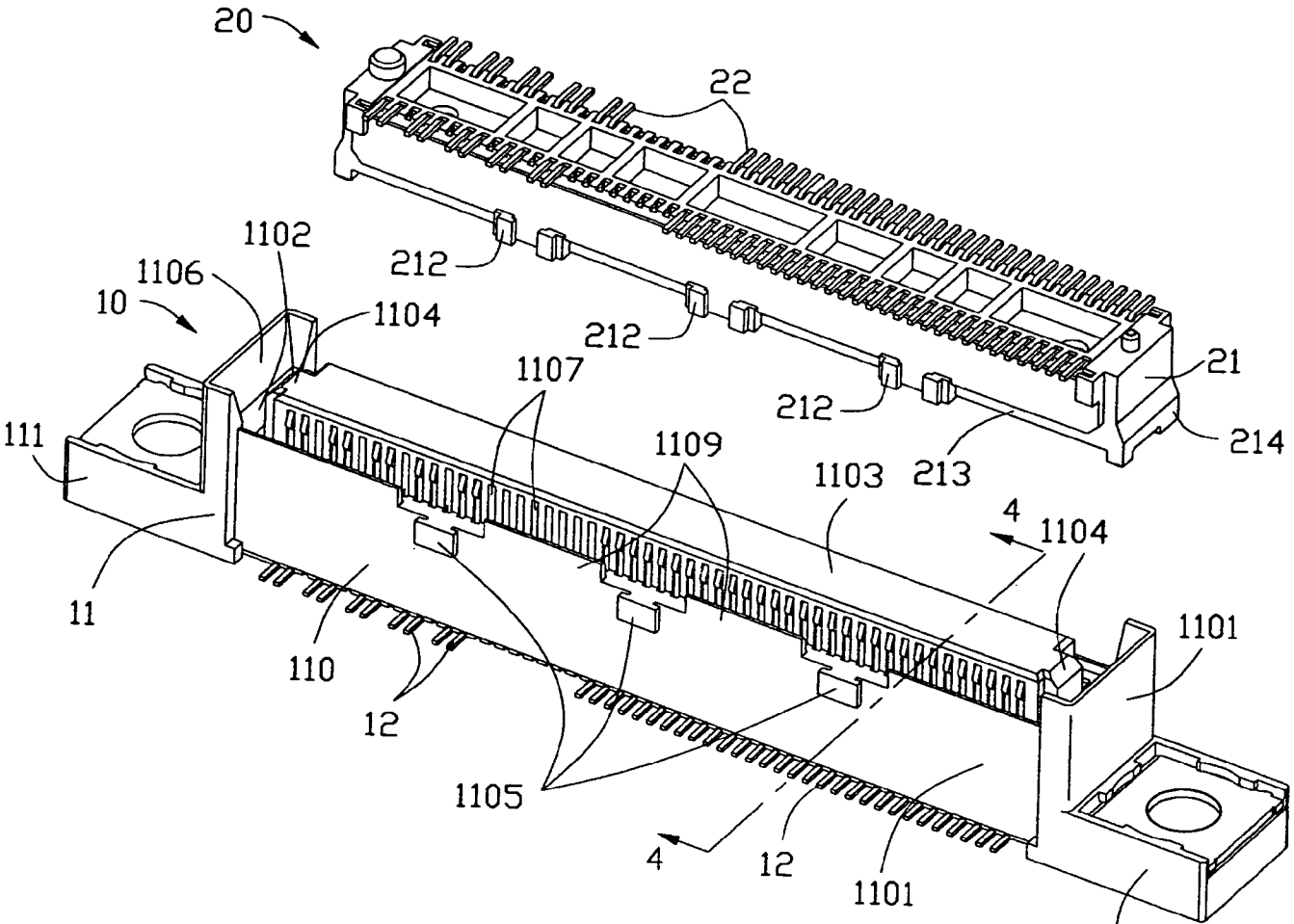
FIG. 1 is a perspective view of an electrical connector of the present invention and a receptacle connector.

Referring to FIG. 1, the electrical connector 10 in accordance with the present invention is used to be mounted to a print circuit board (not shown) and mates with a complementary connector 20, the electrical connector 10 comprises an elongated insulating housing 11 and a plurality of contacts 12 received in the insulating housing 11. The complementary connector 10 comprises an elongated insulating housing 21 and a plurality of contacts 22 received in the insulating housing 21.

Figure 2:
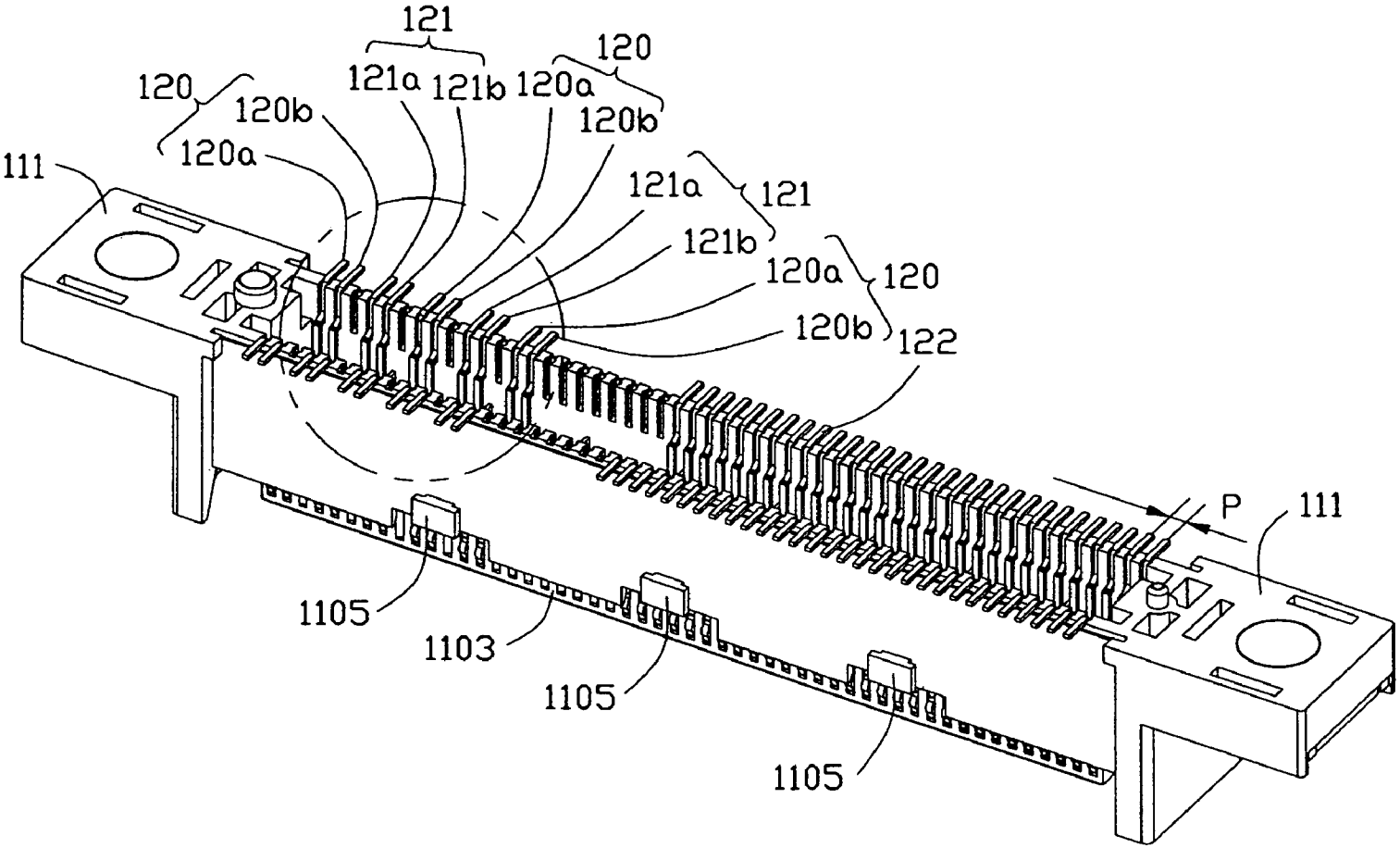
FIG. 2 is another perspective view the electrical connector of the present invention.
Figure 3:
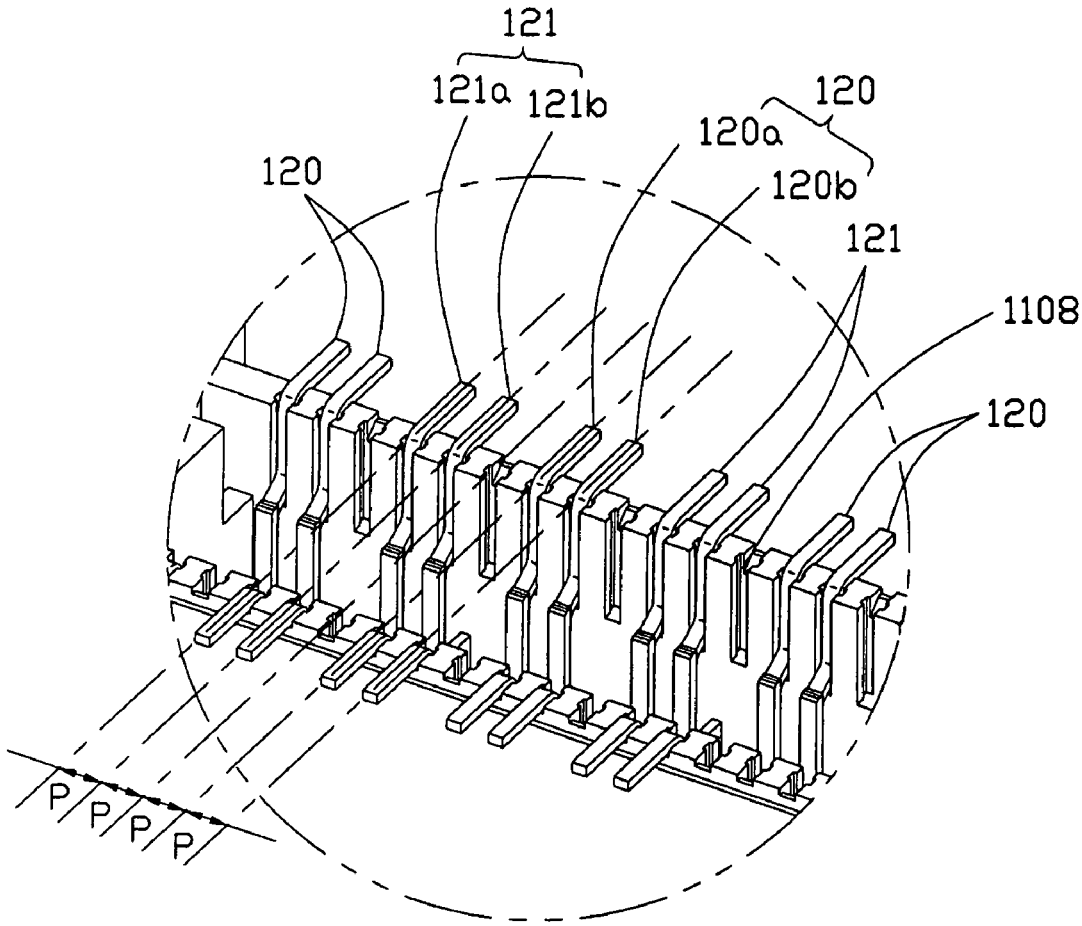
FIG. 3 is a partial enlarged view of the electrical connector.
Figure 4:
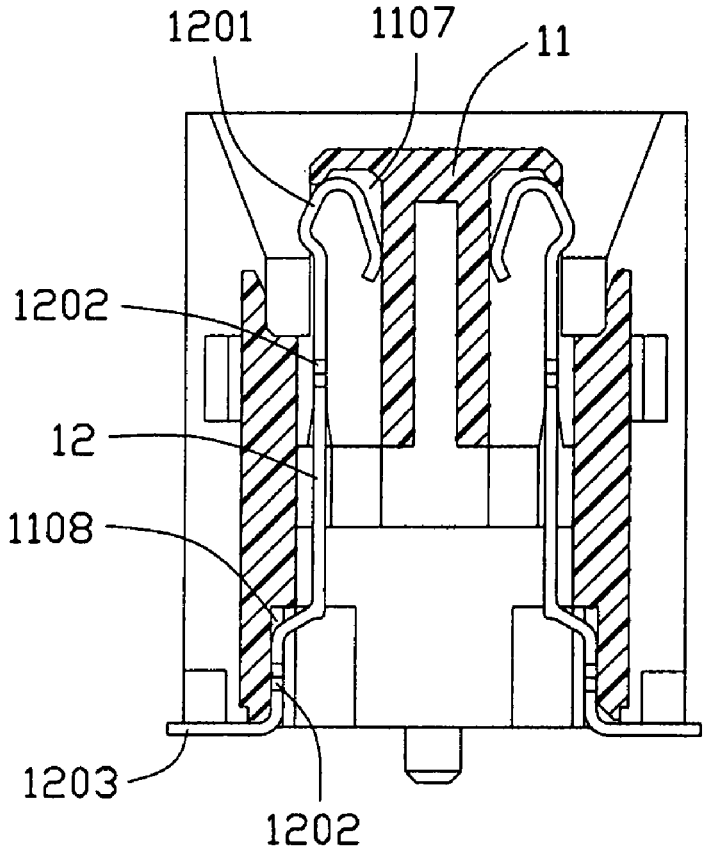
FIG. 4 is sectional view of the electrical connector, taken from line 4-4.

Referring to FIGS. 1 and 2, the insulating housing 11 of the electrical connector 10 has a main body 110 and two mounting portions 111 extending from a bottom edge of two opposed ends of the main body 110. The main body 110 has a peripheral wall 1101, a mating portion 1103 extending from center thereof and surrounded by the peripheral wall 1101, a pair of recess 1102 between two ends of the mating portion and the peripheral wall 1101, and a rectangles room (not labeled) defined by the peripheral wall 1101 below the mating portion 1103. The peripheral wall 1101 comprises two longitudinal walls and two end walls higher than the longitudinal walls, each longitudinal wall is formed with a plurality of protruding portions 1105 on an outside surface thereof (referring to FIG. 2), an uncontinuous top edge 1109 of each longitudinal wall up the protruding portions 1105 is thinned from an inner side. Each end wall is formed with a guiding surface 1106 on an inner surface thereof for guiding the complementary connector 20. The mating portion 1103 is higher than the longitudinal walls and lower than the end walls, the mating portion 1103 has two anti-mismating ribs 1104 on opposed ends thereof. The mating portion 1103 defines a plurality of upright grooves 1107 on two opposed side surfaces thereof, which are arranged along a longitudinal direction. The groove 1107 and further extending downwardly though the insulating housing 11 to communicate with the room, and the longitudinal wall defines a plurality of upright slots 1108 on an inner surface thereof (referring to FIG. 4) exposed in the room, each groove 1107 is corresponding to a slot 1108. The grooves 1107 are equidistant, and the slots 1108 are equidistant too, a distance between midlines of each two adjacent slots 1108 and each two adjacent grooves 1107 is defined as "P". The mounting portion 111 defines a screw (not labeled) on a center thereof for receiving a blot (not shown) to mount the electrical connector 10 to the print circuit board (not shown).

Referring to FIGS. 1-4, each contact 12 has a retaining portion (not labeled), an elastic contacting arm 1201 upwardly extending from an end of the retaining portion and a soldering portion 1203 horizontal extending beyond the insulating housing from the other end of the retaining portion for being soldered to the print circuit board. The contacts 12 are assembled into the grooves 1107 and the slots 1108 from bottom to top, an inwardly bended end of the elastic contacting arm 1201 abuts against an inner sidewall of the groove 1107, the retaining portion has a plurality of stabs 1202 to respectively interferentially engaging with insulating housing 11 to retain the contacts 12.

The contacts 12 comprise a plurality of grounding contacts 120 and a plurality of signal contacts 121. Two signal contacts 121*a* , 121*b* and two grounding contacts 120*a* , 120*b* respectively form a signal group and a grounding group. The signal contacts 121 and the grounding contacts 120 are alternately arranged in the grooves 1107 and slots 1108 by means of each signal group being disposed between two adjacent grounding groups and an empty groove 1107 which do not receive any contact 12 is reserved between each signal group and a adjacent grounding group. Since grounding groups locate on both sides of each signal group, so the signal contacts 121 are prevented from EMI (Electro Magnetic Interference). Furthermore, each two adjacent signal groups have a far distance and have a grounding group disposed therebetween, so cross talk between the signal groups also can be reduced. The arrangement of the grounding contacts 120 and the signal contacts 121 can obtain a preferable impedance to ensure a high transmission quality of high-frequency signals.

The contacts 12 further comprise a plurality of power contacts 122, the grounding and signal contacts 120, 121 are alternately disposed on a left end of the mating portion 1103, the power contacts 122 are continuously disposed on a right end of the mating portion. There is a space between the power contacts 122 and nearest grounding contact 120 and signal contact 121 to prevent the power contact 122 from electro magnetic interfering the grounding contacts 120 and signal contacts 121.

Figure 5:
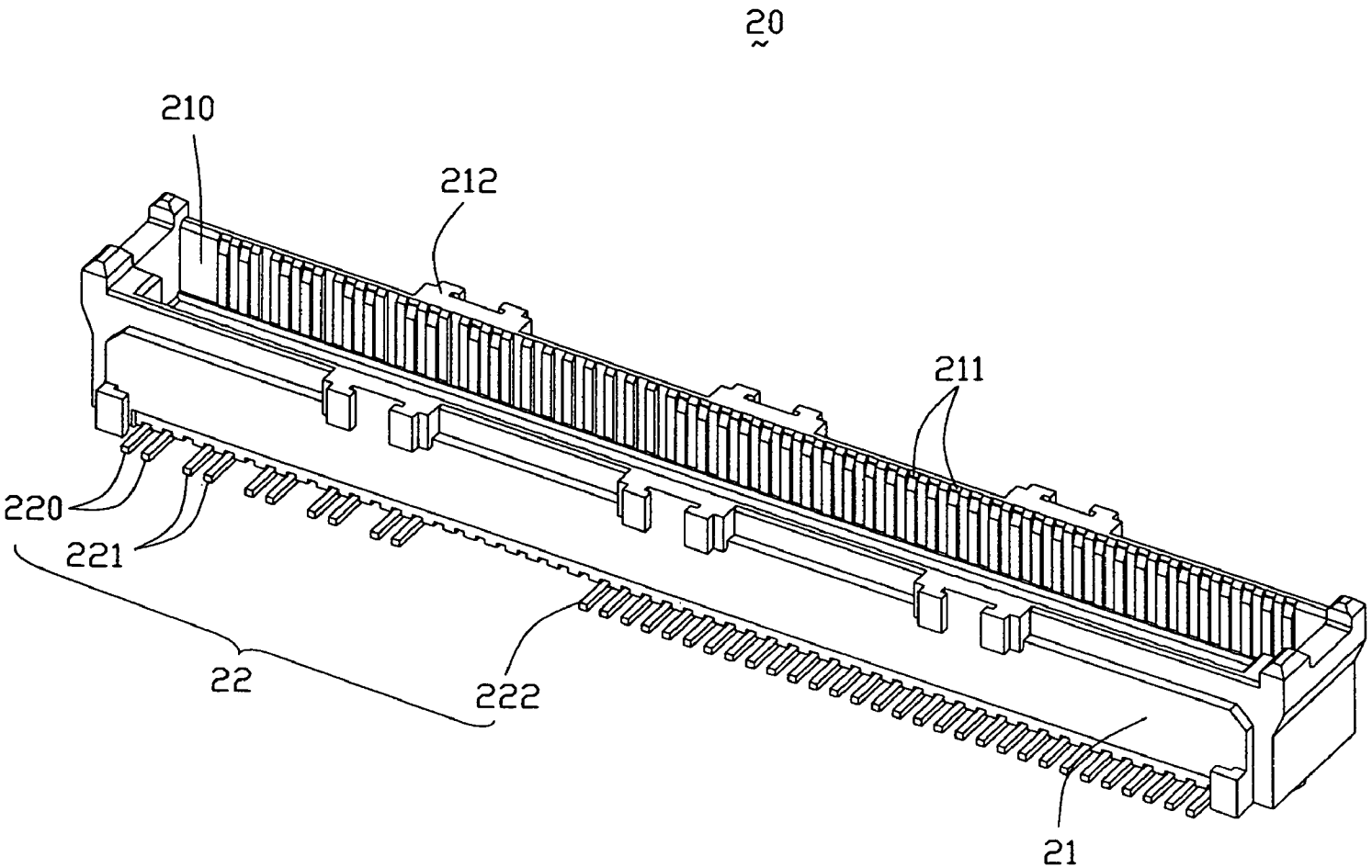
FIG. 5 is an perspective view of the receptacle connector.

Referring to FIGS. 1 and 5, the complementary connector 20 has a housing 21 and a plurality of terminals 22 received in the housing 21. The housing 21 has a peripheral wall 1101 including two opposed longitudinal walls and two end walls and defines a receiving room 210 surrounded by the peripheral wall 1101 for receiving the mating portion 1103 of the electrical connector 10. The longitudinal sidewall defines a plurality of upright channels 211 in an inner surface thereof for receiving the terminals 22 and is formed with a plurality of protruding portions 212 on an out surface thereof, and an top edge 213 of each longitudinal wall besides the protruding portions 212 is recessed from an out side thereof. Each end wall of the peripheral wall 1101 has a pair of anti-mismating portions on inner sides thereof, and a top portion 214 of the end wall outwardly protrudes.

The terminal 22 also comprises a plurality of grounding terminals 220, a plurality of signal terminals 221 and a plurality of power terminals 222, and an arrangement manner of the grounding terminals 220, the signal terminals 221 and the power terminals 222 is corresponding to that of the contacts 12 of the electrical connector 10, here we will not give unnecessary details.

When the electrical connector 10 engages with the complementary connector 20, the guiding surfaces 1106 guide two ends of the housing 21 inserting. The top portions 214 of the end walls of the complementary connector 20 received in the recess 1102 to abut against the inner sidewall of the end wall of the electrical connector 10, and the top edges 1109 of the electrical connector 10 engages with the top edges 213 of the complementary connector 20, by this way, the complementary connector 20 can fast engage with the electrical connector 10. Then, the mating portion 1103 of the electrical connector 10 is received in the receiving room 210 of the complementary connector 20, while the housing 21 is received in, the grounding terminals 220, signal terminals 221 and the power terminals 222 will electrically contact with corresponding grounding contacts 120, signal contacts 121 and power contacts 122, respectively.

Otherwise, the signal group or grounding group may only have one contact 12, and may also have more than two contacts 12, that will not influence a performance of the signal transmission.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

a longitudinal insulating housing defining a plurality of grooves;

a plurality of contacts received in the grooves, each contact having a contacting arm, a retaining portion retained into the insulating housing and a soldering portion, the contacts comprising a plurality of signal contacts and grounding contacts, at least two signal contacts defining a signal group and at least one grounding contact defining a grounding group, each signal group and each grounding group being alternately arranged, and a distance between a signal group and a adjacent grounding group being larger than a distance of adjacent signal contacts in a same signal group;

wherein a groove between each signal group and a corresponding adjacent grounding group keeps empty without any contact;

wherein the contacts have a plurality of power contacts, which are arranged on a side of the signal and grounding contacts and have a space from the nearest grounding contact or signal contact;

wherein the insulating housing has a main body, the main body has a peripheral wall, a receiving space surrounded by the peripheral wall and a mating portion extending from center of the receiving space and upwardly extended beyond the peripheral wall, the grooves are formed on opposed side surfaces of the mating portion, and a rib positioned along each side end of the mating portion; and wherein the slots are formed on inner side surfaces of the peripheral wall and are corresponding to the grooves, the retaining portion is retained in the slot, the contacting arm upwardly extends from the retaining portion to be received in the corresponding groove formed on the mating portion, and the soldering portion horizontally and outwardly extends from the retaining portion.

2. The electrical connector as described in claim 1, wherein the insulating housing defines a plurality of slots for retaining the retaining portions of the contacts, a slot between each signal contact and a corresponding adjacent grounding contact keeps empty without any contact.

3. The electrical connector as described in claim 2, wherein the grooves and the slots are equidistant, respective.

4. An electrical connector assembly comprising:

a first electrical connector having a first insulating housing with a mating portion having a rib along each side end thereof, and surrounded by a first peripheral wall which includes a pair of opposite first longitudinal side wall sections extending in a lengthwise direction, and a plurality of first contacts received in the first insulating housing, said mating portion extending upwardly beyond said pair of longitudinal side wall sections in a vertical direction perpendicular to said lengthwise direction, each of said side wall sections defining at least one notch at a top edge with at least one first protrusion extending from an outer face of the corresponding first side wall section around the notch in a lateral direction perpendicular to both said longitudinal direction and said vertical direction; and a second electrical connector having a second insulative housing having a second peripheral wall defining a receiving room for receiving the mating portion of the first connector, said second peripheral wall which includes a pair of opposite second longitudinal side wall sections extending in said longwise direction, and a plurality of second contacts, a step formed on an outer surface of each of said second longitudinal side wall sections around a top edge thereof, at least one second protrusion extending in the lateral direction from said outer surface around said top edge of the corresponding side wall section and beyond the corresponding step in the vertical direction; wherein when said first connector and said second connector are mated with each other, the step formed on the second side wall section is essentially aligned with the top edge of the corresponding first side wall section in the vertical direction, and said at least one second protrusion extends through the notch in the lateral direction, and abuts against said at least one first protrusion in the vertical direction;

wherein the first and second contacts each comprising a plurality of signal contacts and grounding contacts, at least two signal contacts defining a signal group and at least one grounding contact defining a grounding group, each signal group and each grounding group being alternately arranged, and a distance between a signal group and a adjacent grounding group being larger than a distance of adjacent signal contacts in a same signal group.

5. The electrical connector assembly as claimed in claim 4, wherein the first housing defines an inner surface from which a mating portion extends in the vertical direction, under a condition that said notch extends flush with said inner surface in said vertical direction.

6. The electrical connector assembly as claimed in claim 4, wherein the first housing defines an inner surface from which a mating portion extends in the vertical direction, under a condition that a top face of the first protrusion is flush with said inner surface.

7. The electrical connector assembly as claimed in claim 4, wherein a top face of the second protrusion is flush with the top edge of the corresponding second side wall section.

8. The electrical connector assembly as claimed in claim 4, wherein the first housing defines an inner surface from which a mating portion extends in the vertical direction, under a condition that the top edge of the second side wall section abuts against said inner surface.

9. The electrical connector assembly as claimed in claim 4, wherein the top edge of the first side wall section intimately contacts the step of the corresponding second side wall section.

* * * * *